US008156675B2

(12) United States Patent
Heath

(10) Patent No.: US 8,156,675 B2
(45) Date of Patent: Apr. 17, 2012

(54) FIREARM MAGAZINE

(75) Inventor: Marcus A. Heath, Ogden, UT (US)

(73) Assignee: Browning, Morgan, UT (US)

( * ) Notice: Subject to any disclaimer, the term of this patent is extended or adjusted under 35 U.S.C. 154(b) by 720 days.

(21) Appl. No.: 11/683,847

(22) Filed: Mar. 8, 2007

(65) Prior Publication Data

US 2010/0269388 A1 Oct. 28, 2010

(51) Int. Cl.
*F41A 9/65* (2006.01)

(52) U.S. Cl. ..... 42/49.01; 42/17

(58) Field of Classification Search ..... 42/49.01, 42/50, 6, 106, 17, 18, 19, 21, 22
See application file for complete search history.

(56) References Cited

U.S. PATENT DOCUMENTS

| | | | | |
|---|---|---|---|---|
| 1,008,162 | A | 11/1911 | Krnka | |
| 1,042,837 | A | 10/1912 | Tatarek | |
| 1,281,497 | A | 10/1918 | Bräuning | |
| 1,306,972 | A | 6/1919 | Nelson | |
| 1,833,431 | A | 11/1931 | McCormick et al. | |
| 2,007,774 | A | 7/1935 | Sedgley et al. | |
| 2,064,888 | A | 12/1936 | Dickinson | |
| 2,066,361 | A | 1/1937 | Nomar | |
| 2,114,311 | A | 4/1938 | Nomar | |
| 2,130,722 | A | 9/1938 | Kobe | |
| 2,131,412 | A | 9/1938 | Ostman | |
| 2,321,720 | A | 5/1941 | Whittaker | |
| 2,311,497 | A | 2/1943 | Van Horn et al. | |
| 2,338,984 | A | 1/1944 | Van Horn et al. | |
| 2,341,869 | A * | 2/1944 | Johnson, Jr. | 42/19 |
| 2,367,572 | A | 1/1945 | Gazda | |
| 2,394,606 | A | 2/1946 | Gazda | |
| 2,506,409 | A * | 5/1950 | Baumwart | 89/34 |
| 2,638,694 | A * | 5/1953 | Morris | 42/24 |
| 2,642,688 | A * | 6/1953 | Johnson, Jr. | 42/50 |
| 3,239,959 | A * | 3/1966 | Sefried et al. | 42/19 |
| 3,373,521 | A | 3/1968 | Into | |
| 3,390,475 | A | 7/1968 | Badali et al. | |
| 3,562,944 | A | 2/1971 | Wagner et al. | |
| 3,745,687 | A | 7/1973 | Koon, Jr. | |
| 4,027,415 | A | 6/1977 | Stoner | |
| 4,314,419 | A * | 2/1982 | Koon, Jr. | 42/50 |
| 4,332,097 | A | 6/1982 | Taylor, Jr. | |
| 4,366,638 | A | 1/1983 | Ketterer et al. | |
| 4,384,508 | A | 5/1983 | Sullivan et al. | |
| 4,413,546 | A | 11/1983 | Taylor, Jr. | |
| 4,445,418 | A | 5/1984 | Sullivan et al. | |
| 4,471,549 | A | 9/1984 | Brint et al. | |
| 4,487,103 | A | 12/1984 | Atchisson | |
| 4,524,672 | A | 6/1985 | Balsavage | |
| 4,524,673 | A | 6/1985 | Golden | |
| H164 | H | 11/1986 | Savioli | |
| 4,658,700 | A | 4/1987 | Sullivan | |
| 4,676,137 | A | 6/1987 | Stockton et al. | |
| 4,689,907 | A | 9/1987 | Gwinn, Jr. | |
| 4,744,164 | A | 5/1988 | Rieger | |

(Continued)

*Primary Examiner* — Benjamin P Lee
(74) *Attorney, Agent, or Firm* — Holland & Hart

(57) ABSTRACT

A magazine for a firearm may include a cavity that is shaped to prevent the tip of the bullets in the cartridges from contacting the magazine when the firearm recoils. The magazine may also be configured so that the cartridges in the magazine exit the cavity at least approximately in the center of the magazine. The magazine may be configured to include a biasing mechanism that pushes the cartridges upward in the cavity. The biasing mechanism may be configured to allow the magazine to be compact, simple, and reliable.

32 Claims, 7 Drawing Sheets

U.S. PATENT DOCUMENTS

| | | | | |
|---|---|---|---|---|
| 4,745,842 | A | 5/1988 | Shou-Fu | |
| 4,766,800 | A | 8/1988 | Miller et al. | |
| D297,661 | S | 9/1988 | Gwinn, Jr. | |
| 4,811,510 | A | 3/1989 | Chesnut | |
| 4,888,898 | A | 12/1989 | Miller et al. | |
| 4,926,742 | A | 5/1990 | Ma et al. | |
| 4,965,951 | A | 10/1990 | Miller et al. | |
| 4,970,820 | A | 11/1990 | Miller et al. | |
| 5,533,291 | A | 7/1996 | Boland | |
| 5,561,258 | A | 10/1996 | Bentley et al. | |
| 5,600,083 | A | 2/1997 | Bentley et al. | |
| 5,628,137 | A | 5/1997 | Cortese | |
| 5,761,841 | A * | 6/1998 | Snick | 42/50 |
| 5,771,620 | A | 6/1998 | Crawford et al. | |
| 5,816,444 | A | 10/1998 | David | |
| 6,109,252 | A | 8/2000 | Stevens | |
| 6,327,953 | B1 | 12/2001 | Andresen | |
| 6,367,188 | B1 | 4/2002 | Vargas | |
| 6,502,495 | B1 * | 1/2003 | Beary | 89/34 |
| 6,601,496 | B1 | 8/2003 | Kalashnikov et al. | |
| 6,837,844 | B1 | 1/2005 | Ellard et al. | |
| 2006/0283431 | A1 | 12/2006 | Lee et al. | |
| 2007/0151440 | A1 | 7/2007 | Cook et al. | |

* cited by examiner

FIREARM MAGAZINE

BACKGROUND

A magazine is an ammunition storage and feeding device used with a firearm. The magazine holds ammunition cartridges and feeds them automatically into the chamber of the firearm (e.g., handgun, rifle, or shotgun). Most magazines are configured to be easily inserted into and removed from the firearm. A smaller number of magazines are formed as an integral part of the firearm. In general, removable magazines are favored over integral magazines because removable magazines allow the user to replace an empty magazine quicker and easier. Conventional magazines can have any of a number of configurations such as, for example, tubular magazines, box magazines, drum magazines, rotary magazines, pan magazines, and helical magazines.

Unfortunately conventional magazines can suffer from any of a number of problems. One problem is that the design of many conventional magazines allows the cartridges to move forward inside the magazine until the bullet impacts the front of the magazine. Every time the firearm is fired, the recoil causes the magazine to move backwards quickly with the firearm. Since the cartridges are not secured in place, the cartridges move forward longitudinally in the magazine until the bullets impact the front of the magazine. This can deform and/or otherwise damage the bullets, which may alter the bullets' flight properties and consequently the bullets' accuracy. In some larger caliber firearms, the force of the bullet impacting the front of the magazine may be great enough to push or seat the bullet further into the cartridge case. When such a cartridge is chambered, the bullet is no longer in the optimum position relative to the barrel to provide the greatest accuracy. For the greatest accuracy, the bullet should be seated in the cartridge case so that when it is chambered the bullet just barely touches or is just slightly spaced apart from the rifling in the barrel.

Another problem with conventional magazines is that they are often large and cumbersome. This may make them more difficult to carry and use as well as potentially being more costly to manufacture. Conventional magazines may also suffer from problems associated with loading the firearm due to the cartridge exiting the magazine at a position that is not directly below the bore. In such a situation, the firearm must be configured to further manipulate the cartridge sideways to get it into the chamber (e.g., the firearm may include a ramp that the bullet slides up to simultaneously lift the cartridge and move it sideways).

Accordingly, it would be desirable to provide an improved ammunition magazine to hold and feed ammunition cartridges into a firearm. In particular, it would be desirable to provide an ammunition magazine that prevents the bullets of the cartridges from being damaged while in the magazine and that is also compact and reliable.

SUMMARY

An improved firearm magazine is described herein. The magazine may have wide applicability in the firearms industry. For example, the magazine may be designed for use with centerfire weapons such as centerfire rifles, handguns, and shotguns. In one embodiment, the magazine may be designed to have a compact profile to reduce any wasted space in the magazine and to make the magazine compatible with firearms that have a narrow receiver. The compact nature of the magazine may also reduce the amount of material to produce the magazine and, consequently, also reduce the cost of the magazine. In another embodiment, the magazine may be configured to be a drum or rotary style magazine. In another embodiment, the magazine may be configured to be inserted upward into an underside of the firearm. It should be appreciated, however, that the magazine may also be configured to be coupled to the firearm in any suitable way. It should also be appreciated that the magazine may be designed to have any suitable combination of the features, advantages, components, etc., that are described herein. Accordingly, although only a single embodiment is shown in the drawings, numerous additional embodiments of the magazine are contemplated having various characteristics and advantages.

In one embodiment, the magazine may include a cavity that is shaped to prevent the cartridges from moving forward longitudinally in the magazine to the point that the bullets contact the front of the magazine. It should be appreciated that the term "bullet," as used herein, refers to the projectile portion of the cartridge and is not meant to refer to the cartridge as a whole. It should also be appreciated that describing the cartridge or the bullet as moving forward longitudinally refers only to the fact that the position of the cartridge or the bullet has changed relative to the magazine so that the cartridge or bullet is positioned closer to the front of the magazine. Referring to the bullet as moving forward longitudinally in the magazine is not meant to only refer to situations where the bullet moves while the magazine is at rest. It can also refer to situations where the magazine moves and the bullet is at rest (e.g., movement caused by the recoil of the firearm).

The cavity in the magazine may be defined by one or more interior surfaces or walls. In one embodiment, the cavity may have the same general shape as the ammunition. For example, the cavity may have a shape that corresponds to the bottlenecked shape of the cartridges. The cavity may be sized so that the shoulders of the cases contact a tapered portion of the interior of the cavity to prevent the tips of the bullets from contacting the front of the magazine.

In another embodiment, the magazine may have a compact yet reliable design. The magazine may have a drum design that includes a biasing mechanism to push the cartridges toward an exit opening in the magazine. In order to make the magazine compact, the biasing mechanism may include a movable member that is configured to rotate a total of no more than 180 degrees (ie., the movable member has a total range of motion that is no more than 180 degrees). The movable member may also be configured to rotate backward no more than 90 degrees past a straight down position. In one embodiment, in order to minimize space, the movable member may be a flat plate. In another embodiment, the magazine may be configured to be no more than 32 mm wide. In yet another embodiment, the magazine may be configured so that all of the cartridges are positioned one above another (i.e., each preceding cartridge is positioned above the next succeeding cartridge to some extent) when the magazine is fully loaded. This allows the magazine to be more compact than drum magazines where the cartridges rotate around a center hub in a full circle.

In another embodiment, the magazine may be configured so that the cartridges are positioned at least approximately in the center of the magazine at the exit opening. The cartridges are configured to be held in the exit opening until the bolt of the firearm slides them longitudinally and slightly upwardly out of the magazine and into the chamber. In another embodiment, the magazine may be coupled to the firearm so that the cartridge at the exit opening of the magazine is positioned directly below the bore of the firearm. This allows the cartridge to be chambered without also moving the cartridge to one side or the other. This may serve to simplify the action of the firearm and lead to greater reliability and usability.

The magazine may also be configured to hold cartridges that are commonly referred to as short magnums (also commonly referred to as short, fat cartridges). In one embodiment, the magazine may be configured to hold three short magnum cartridges. A firearm that uses the magazine may be configured to hold a total of four cartridges at any one time (i.e., one in the chamber and three in the magazine).

DRAWINGS

FIGS. 12A-12C show the magazine loaded with three, two, and one cartridges, respectively.

DETAILED DESCRIPTION

Figure 1:
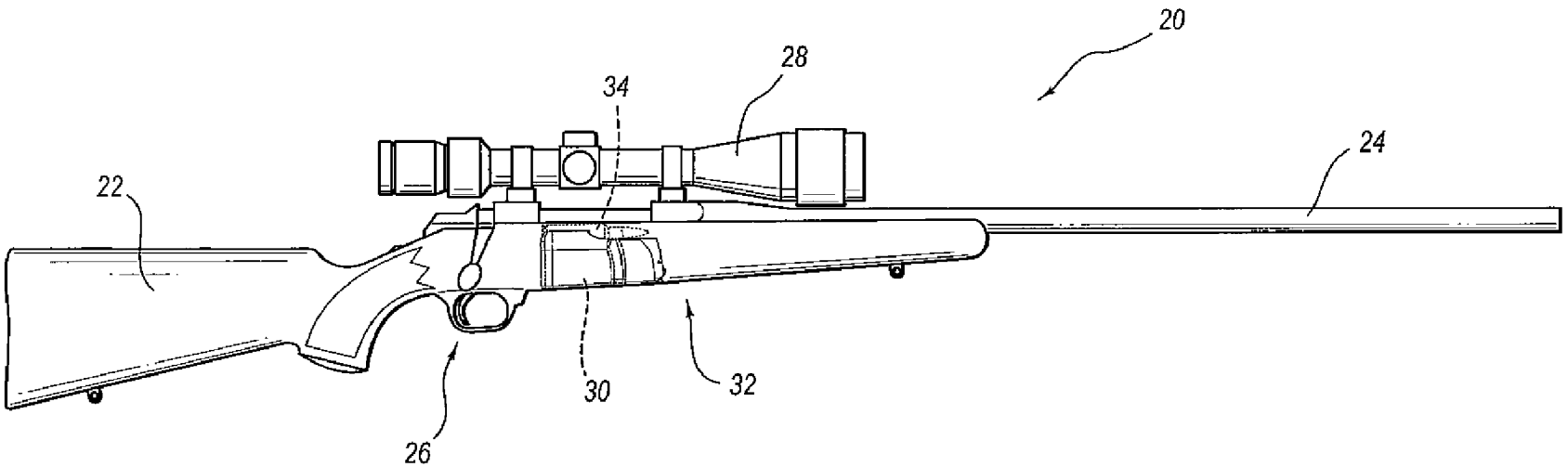
FIG. 1 is a perspective view of a firearm that includes a removable magazine.

A number of embodiments of improved firearm magazines are described herein. Referring to FIG. 1, a firearm 20 is shown that includes a stock 22, a barrel 24, a receiver assembly 26, a scope 28, and a magazine 30 (also referred to herein as an ammunition magazine, clip, ammunition clip, cartridge magazine, or cartridge clip). The magazine 30 is positioned in a cavity in the underside 32 of the firearm 20 as indicated by the dashed lines in FIG. 1. The magazine 30 is configured to store and feed cartridges or ammunition 34 into the firearm 20.

It should be appreciated that the firearm 20 is exemplary of any of a number of firearms that are suitable for use with the magazine 30. For example, although the firearm 20 is shown with a bolt action, it should be appreciated that the magazine 30 may also be used with other firearms that have other manually actuated actions such as lever actions, pump actions, and the like, as well as firearms that have automatically actuated actions such as semi and fully automatic firearms. In one embodiment, the firearm 20 is a centerfire rifle and the magazine 30 is configured to hold centerfire cartridges.

Figure 2:
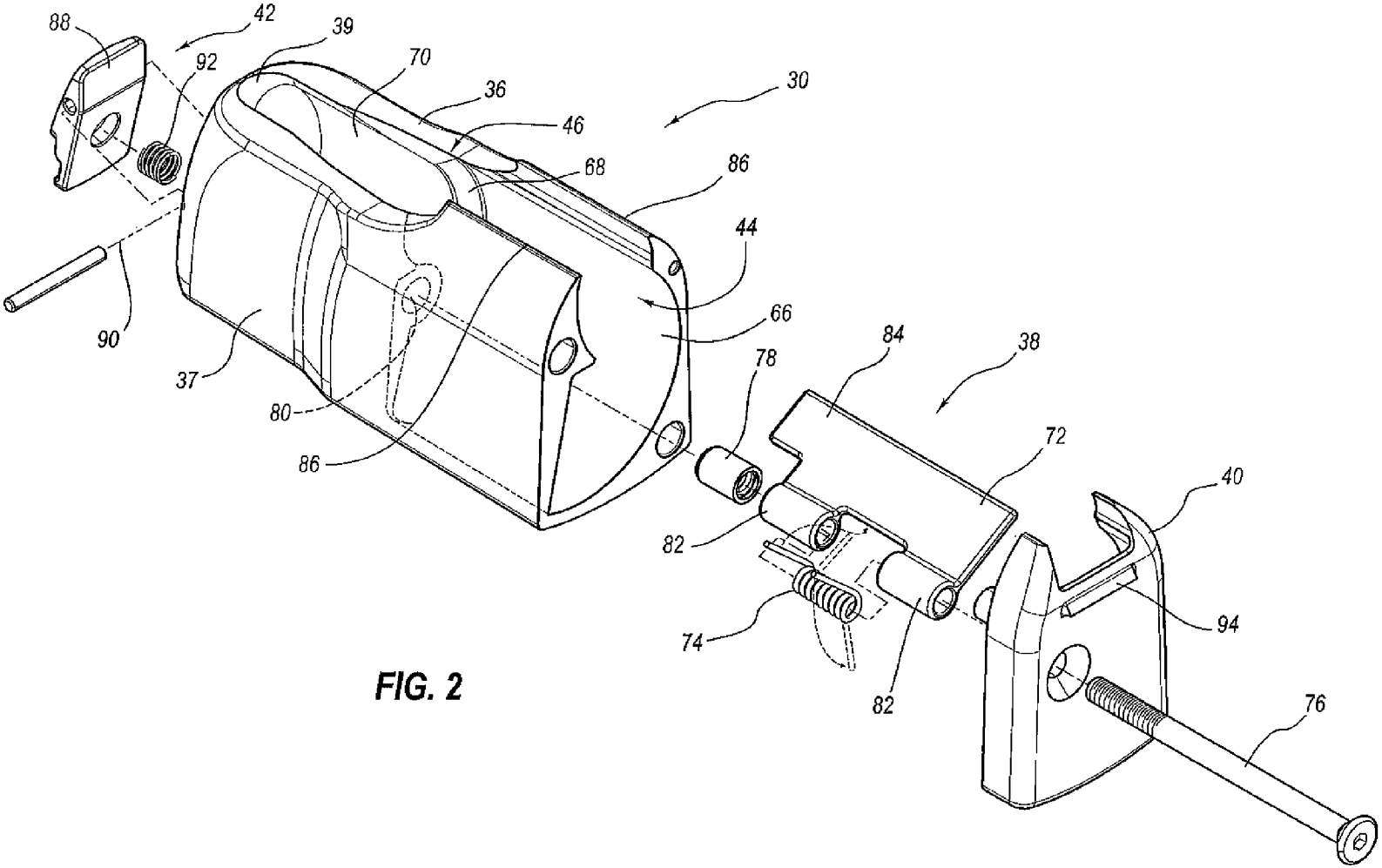
FIG. 2 is an exploded view of the magazine shown in FIG. 1.
Figure 4:
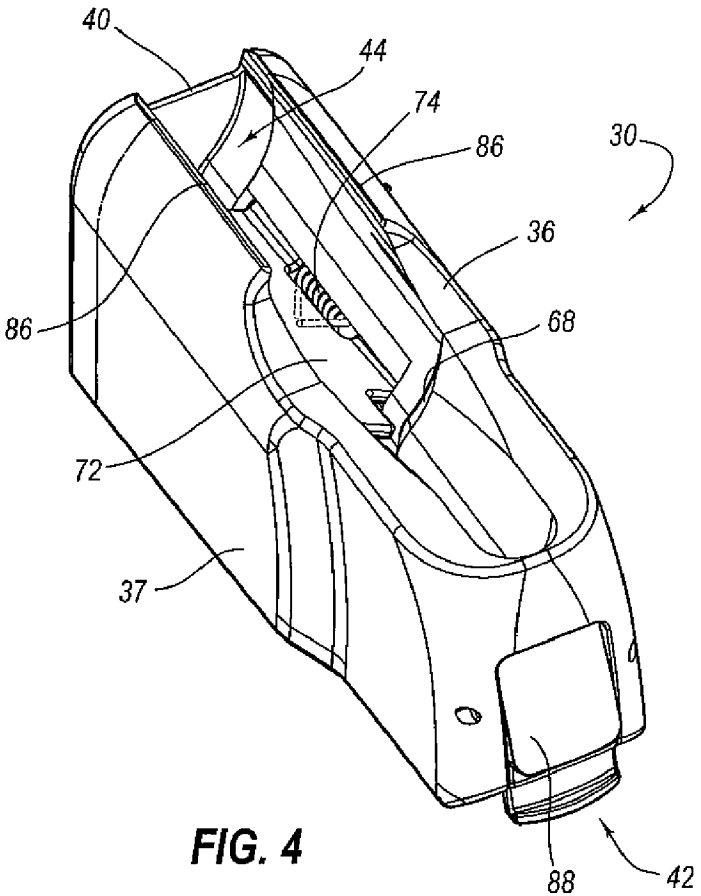
FIGS. 3-4 are perspective views of the magazine shown in FIG. 1.
Figure 3:
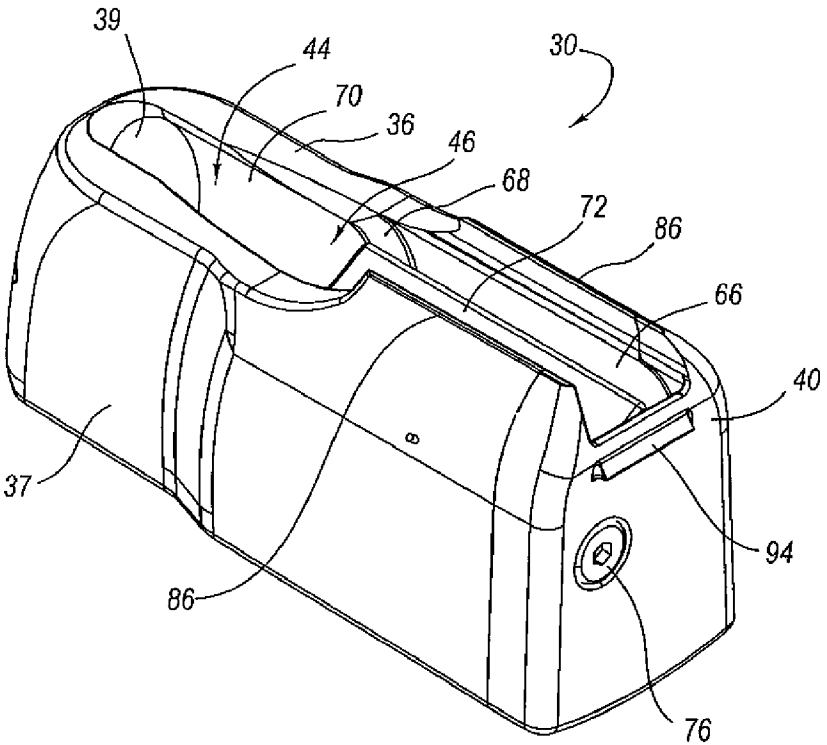
Figure 6:
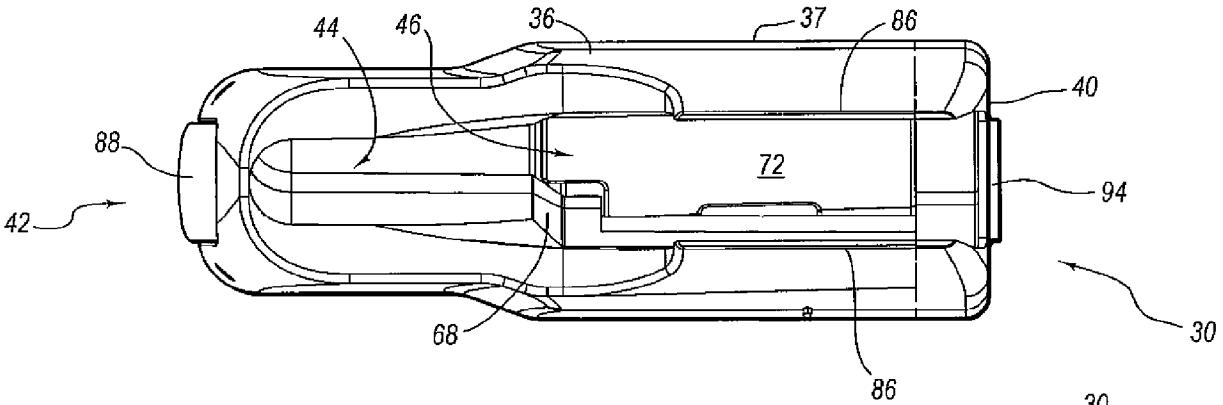
FIGS. 5-8 are side, top, back, and front views, respectively, of the magazine shown in FIG. 1.
Figure 8:
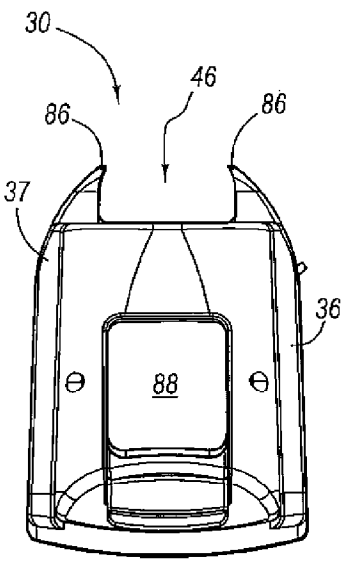

An exploded view of the magazine 30 is shown in FIG. 2. The magazine 30 includes a housing 36, a biasing mechanism 38 (also referred to herein as a follower mechanism or rotor mechanism) positioned in the housing 36 to push the cartridges upward, and a coupling mechanism 42 to secure the magazine 30 to the firearm 20. The housing 36 includes a main body 37 coupled to a back plate or end plate 40. The housing 36 forms a plurality of interior surfaces, including a front wall or surface 39, that define a cavity 44 sized and shaped to receive the cartridges 34.

It should be appreciated that the housing 36 may have any of a number of suitable configurations. For example, the housing 36 may be formed using three or more components that when coupled together form the cavity 44. In addition, the housing 36 may also be formed from a single piece of material. The housing 36 may also be made from any suitable material such as plastic, metal, composites, or the like.

Figure 9:
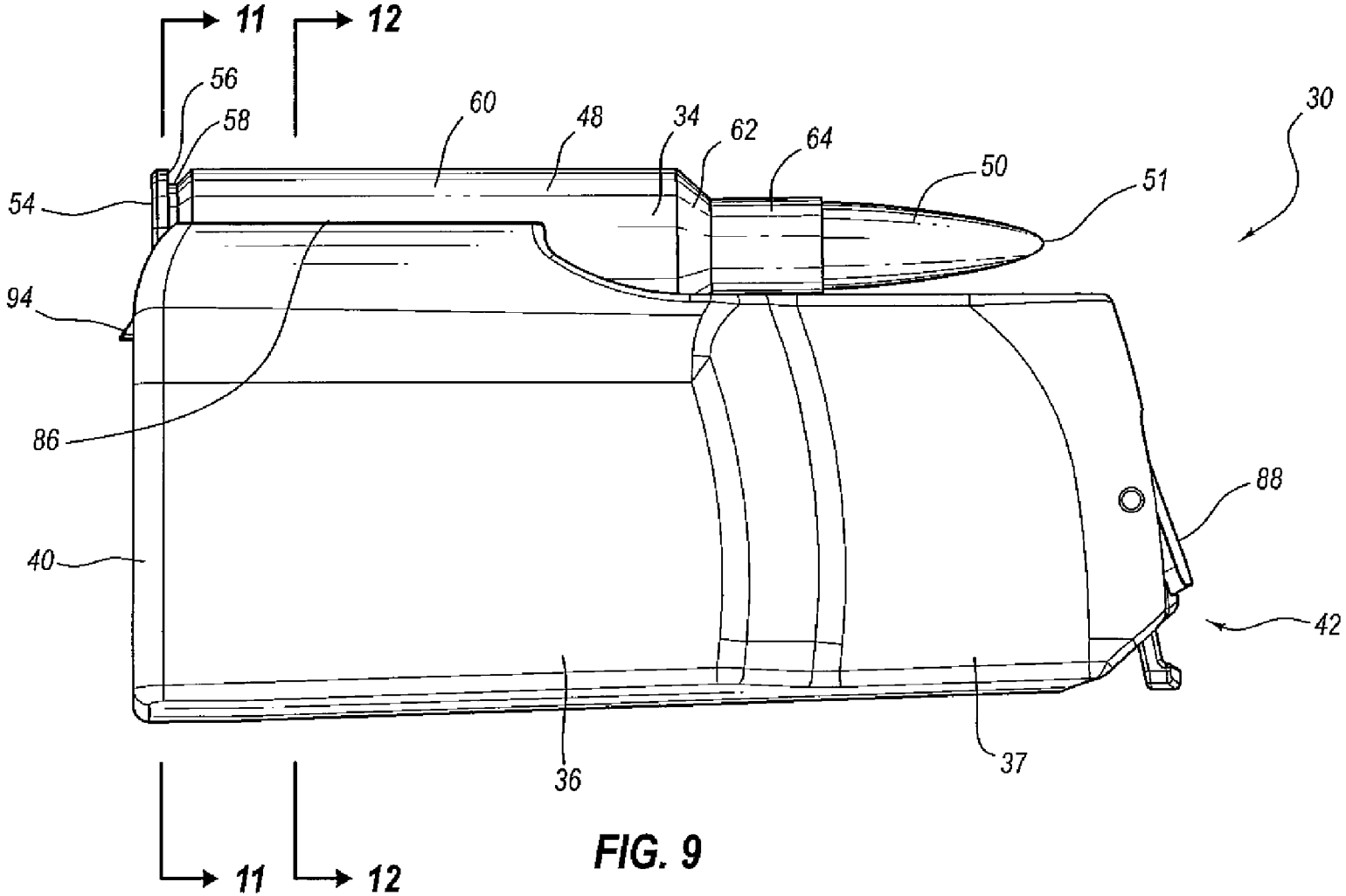
FIG. 9 is a side view of the magazine shown in FIG. 1 having a plurality of cartridges positioned in it.
Figure 11:
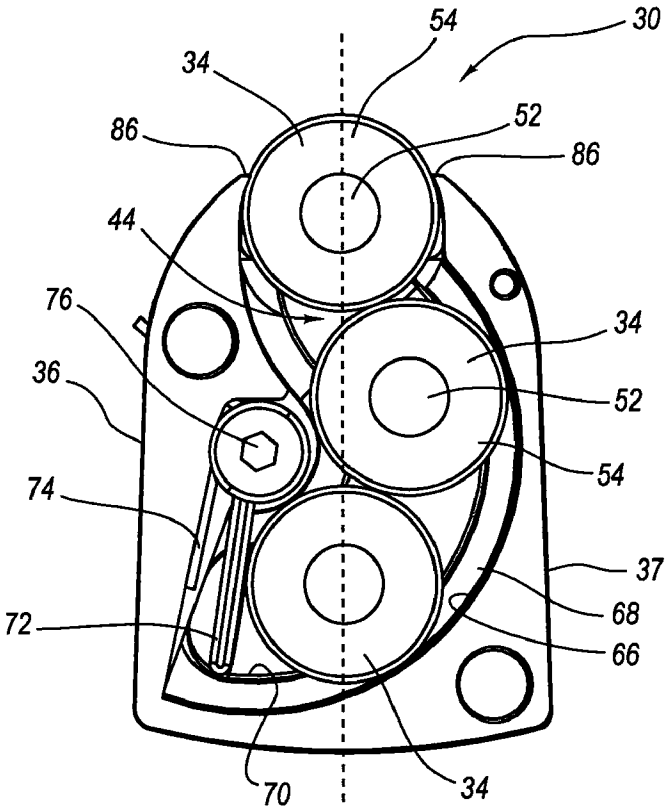
FIG. 11 is a cross-sectional view of the magazine along the line 11-11 shown in FIG. 9.

Referring to FIGS. 9 and 11, the cartridges 34 each include a case 48, a bullet 50 coupled to the case 48, a primer 52, and propellant or powder (not shown) positioned inside the case 48. It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The case 48 includes a head 54, a rim 56, a body or large diameter portion 60, a shoulder or tapered portion 62, and a neck or small diameter portion 64. The primer 52 fits in a recess in the head 54 and ignites the propellant upon being struck by the firing pin of the firearm 20. The rim 56 extends around the perimeter of the head 54. Since the rim 56 is approximately the same diameter as the body 60, the cartridge 34 is commonly referred to as a rimless cartridge. A circular groove or recess 58 in the case 48 just in front of the rim 56 allows the extractor of the firearm 20 to grip the rim 56 to remove the case 48 from the chamber after the firearm 20 has been fired. As shown in FIG. 9, the combination of the body 60, shoulder 62, and neck 64 give the cartridge 34 a bottle-necked shape. The bullet 50 includes a tip 51 and is coupled to the neck 64 of the case 48. The bullet 50 is sized to be snugly received in an opening at the end of the neck 64.

Referring back to FIG. 2, the cavity 44 includes a large diameter portion 66, a tapered portion 68, and a small diameter portion 70 that are shaped to correspond to the body 60, shoulder 62, and neck 64 of the case 48, respectively. The cavity 44 is slightly larger than the case 48 to allow the cartridges 34 to move easily up and down through the cavity 44. A tapered wall or surface forms the tapered portion 68 of the cavity 44. The tapered wall contacts the shoulder 62 of the case 48 to prevent the cartridges 34 from moving forward longitudinally in the magazine 30. This prevents the bullets 50 from contacting the interior front wall 39 of the magazine 30.

It should be appreciated that other cartridges besides those shown in FIGS. 9 and 11 may be used with the magazine 30. For example, straight walled cartridges (i.e., not bottle-necked) may also be used with the magazine 30. If such cartridges are used, the magazine 30 may not provide the advantage of being able to prevent the bullet 50 from moving forward longitudinally and impacting the interior front all 39 of the magazine 30. However, the magazine 30 may still provide a number of advantages over conventional magazines due to other features such as its compact size and the biasing mechanism 38. It should also be appreciated that other bullets besides the bullet 50 can be used with the cartridges 34. Although bullet 50 is shown as being a spitzer type bullet, other bullets such as flat-nosed bullets, round-nosed bullets, and so forth can also be used with the cartridges 34. In one embodiment, the cartridges 34 are short magnum cartridges.

Referring back to FIG. 2, the biasing mechanism 38 is positioned inside the cavity 44 and is configured to push the cartridges 34 upward to the exit opening 46 in the magazine 30. The biasing mechanism 38 includes a movable member 72 (also referred to herein as a follower, rotor, or rotating member) and a biasing member 74. The biasing member 74 is positioned to rotate the movable member 72 upward and thereby push the cartridges 34 to the exit opening 46. The movable member 72 includes a hub portion 82 and a flat plate or flat portion 84. The hub portion 82 holds the movable member 72 in position as it rotates around an axis and the flat plate 84 pushes the cartridges 34 upward in the cavity 44. The axis about which the movable member 72 rotates is offset to the side of a center line extending vertically through the magazine 30 as shown by the dashed line in FIG. 11. In one embodiment, the biasing member 74 is a spring. It should be appreciated, however, that any suitable biasing material or device may use to bias or push the movable member 72 upward.

The biasing mechanism 38 may be coupled to the housing 36 using the bolt 76 and corresponding sleeve 78. The sleeve 78 is threaded and configured to be secured in a hole 80 in the inside of the housing 36 using any suitable method such as with an adhesive. The bolt 76 is configured to extend through a hole in the back plate 40, through the hub portion 82 of the movable member 72, and engage the threads in the sleeve 78. The movable member 72 is configured to rotate freely around the bolt 76.

It should be noted that the configuration of the biasing mechanism 38 provides a number of advantages over conventional magazines. For example, the flat plate configuration of the movable member 72 makes it very compact versus conventional magazines that use a cup shaped device or a star shaped drum to move the cartridges in the magazine. Furthermore, the biasing mechanism 38 is relatively simple to manufacture, assemble, and repair unlike many of the very complicated conventional designs.

Figure 10:
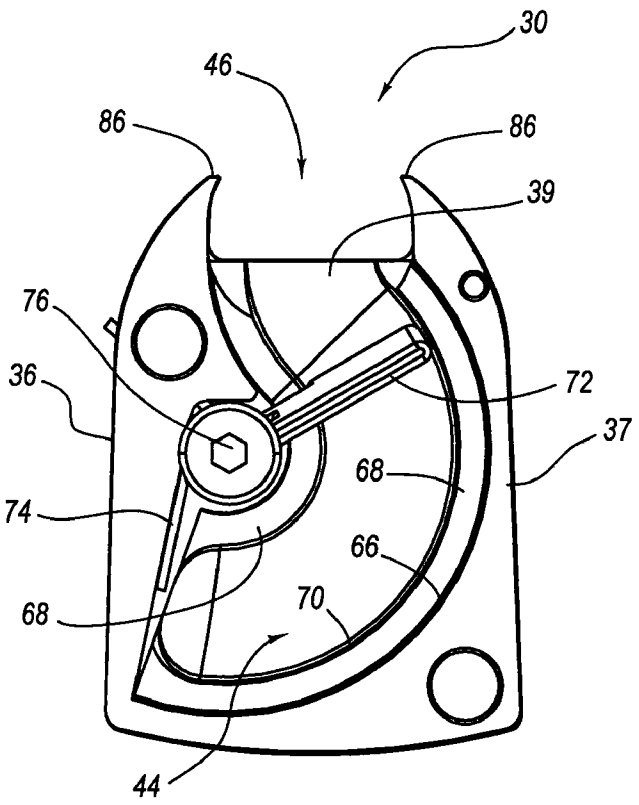
FIG. 10 is a cross-sectional view of the magazine along the line 10-10 shown in FIG. 5.

Referring to FIGS. 10 and 11, the magazine 30 can be loaded with the cartridges 34 by simultaneously pushing the cartridges 34 downward and sliding them underneath retaining edges 86 on the top of the housing 36. As shown in FIGS. 11 and 12A-12C, the distance between the retaining edges 86 is slightly smaller than the diameter of the body 60 of the case 48 so that the retaining edges 86 prevent the uppermost cartridge 34 from popping out of the cavity 44. However, as shown in FIG. 2, the retaining edges 86 are only provided along the back half of the housing 36. Therefore, the cartridges 34 can be simultaneously pressed downward and slid backward to load the magazine 30.

Figure 12C:
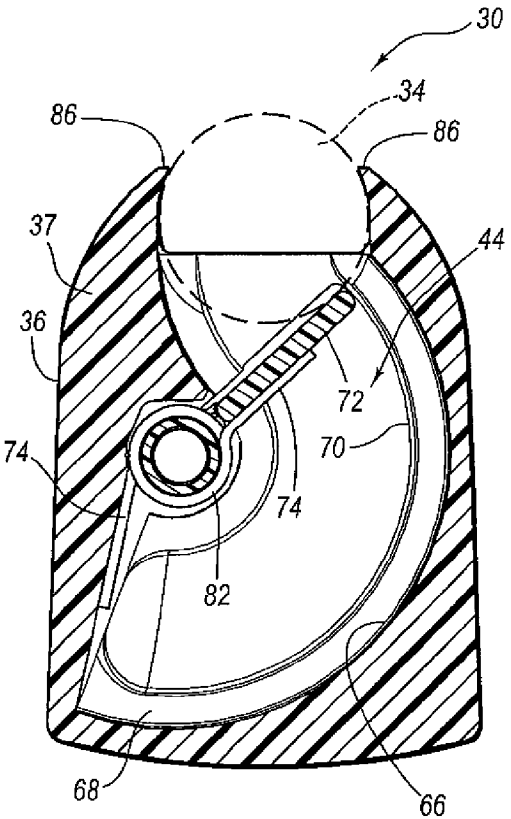
FIGS. 12A-12C are cross-sectional views of the magazine along the line 12-12 shown in FIG. 9.
Figure 12B:
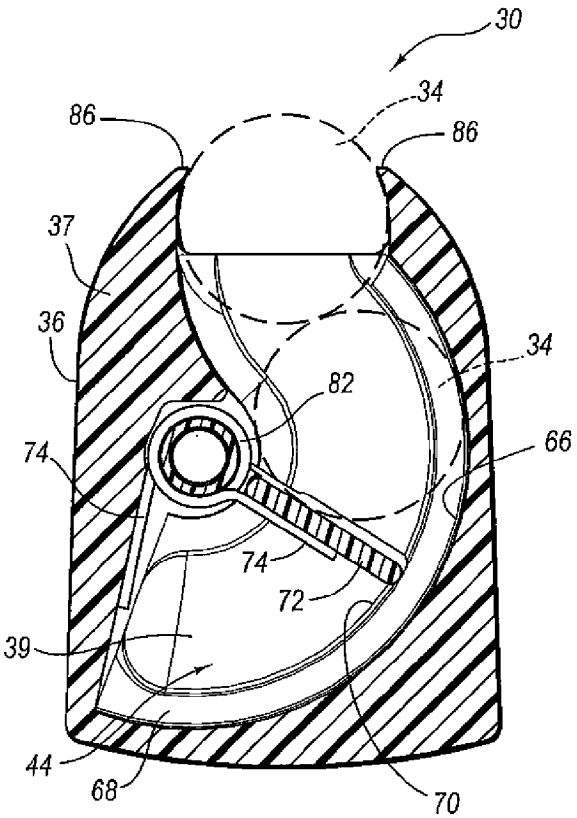
Figure 12A:
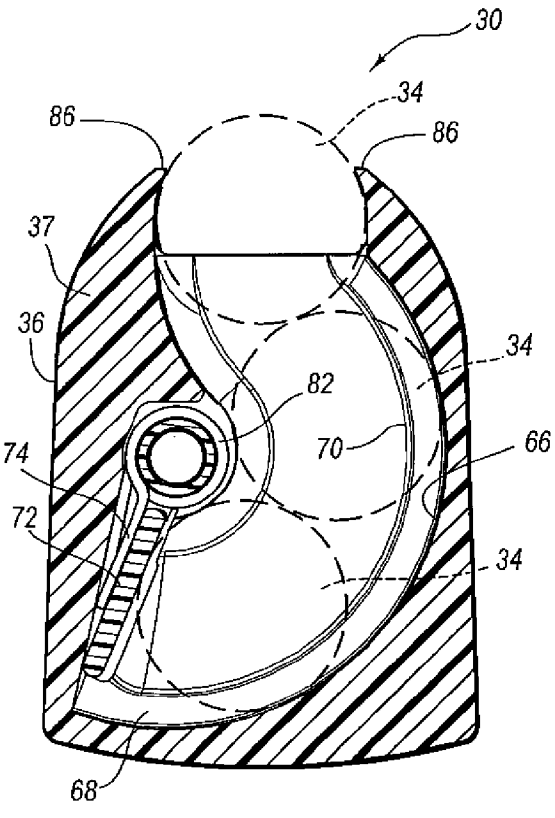

Referring to FIGS. 12A-12C, the full range of movement of the movable member 72 is shown. In one embodiment, the movable member 72 is configured to rotate no more than a total of 180 degrees. Limiting the range of rotation in this manner allows the magazine 30 to be significantly more compact then conventional magazines where the inner hub or cylinder rotates 360 degrees. Also, the movable member 72 may be configured to rotate backward no more than 90 degrees past a straight down position. In other embodiment, the movable member 72 may be configured to rotate backward no more than 60 degrees past a straight down position, no more than 45 degrees past a straight down position, or no more than 30 degrees past a straight down position. Limiting the distance that the movable member 72 can rotate backward past a straight down position also allows the magazine 30 to be more compact. In another embodiment, the magazine 30 may be configured to be no more than 32 mm wide.

Figure 5:
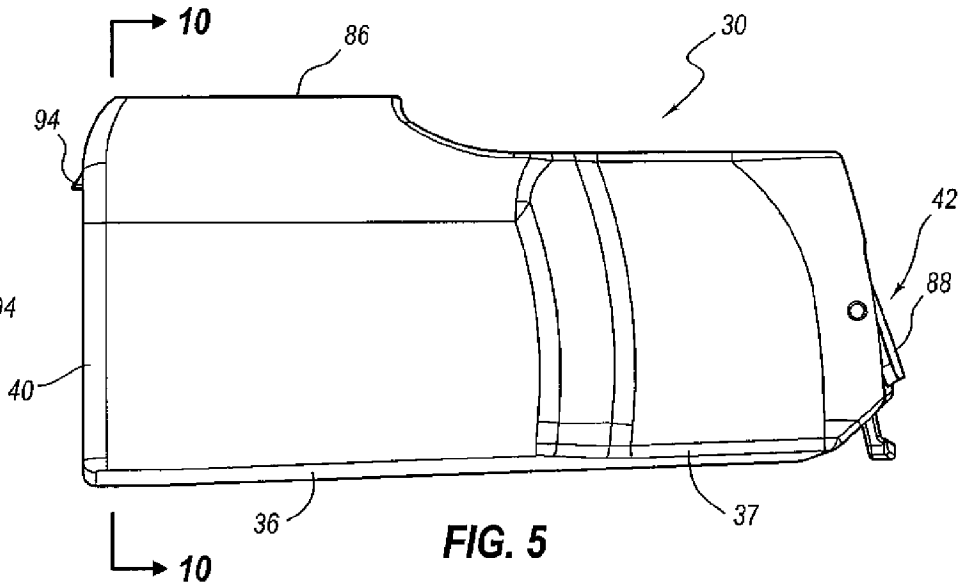
Figure 7:
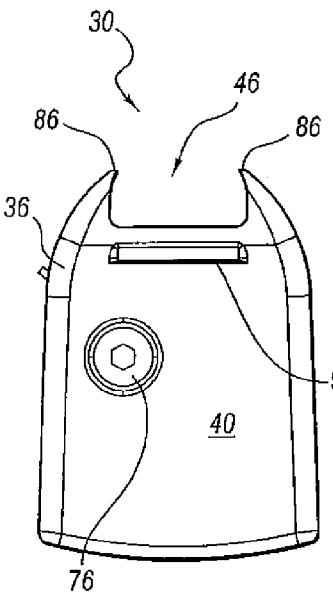

Referring to FIGS. 2-8, the coupling mechanism 42 is provided to secure the magazine 30 into the cavity on the underside 32 of the firearm 30. The coupling mechanism 42 includes a catch 88 that pivots on an axis 90 and is biased outward by a spring 92. As shown in FIG. 5, the catch 88 is positioned on the front of the magazine 30 and another catch 94 is positioned on the back of the magazine 30. When the magazine 30 is inserted into the cavity of the firearm 20, the catch 88 pivots inward to allow the catches 88, 90 to slide past respective supports in the cavity of the firearm 20. Once past the supports, the catch 88 pivots back outward so that the catches 88, 90 lock into place to prevent the magazine 30 from falling out of the firearm 20. In one embodiment, the magazine 30 may be coupled to the firearm 20 by inserting the magazine 30 upwardly into the cavity in the underside 32 of the firearm 20. The cavity in the underside 32 of the firearm 20 may be closed on the sides or may be open so that the magazine 30 is visible on the sides.

Illustrative Embodiments

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

According to one embodiment, a magazine for a firearm comprises: a cavity sized to receive a plurality of cartridges each of which includes a bullet; wherein the cavity is shaped to prevent the bullets from moving forward longitudinally and contacting the magazine; and wherein the magazine is configured to be inserted upward into an underside of the firearm. Each of the plurality of cartridges may include a case having a shoulder, and the cavity may be shaped so that the shoulders of the cases contact the magazine to prevent the bullets from moving forward longitudinally and contacting the magazine. The magazine may be configured so that the plurality of cartridges exit the cavity at least approximately in the center of the magazine. The plurality of cartridges may be positioned one above another when the magazine is fully loaded. The magazine may comprise a movable member positioned in the cavity, the movable member being configured to rotate and push the plurality of cartridges upward in the cavity. The movable member may be configured to rotate a total of no more than 180 degrees. The movable member may be configured to rotate backward no more than 90 degrees past a straight down position. The movable member may be a flat plate. The magazine may be no more than 32 mm wide. The plurality of cartridges may be centerfire cartridges. A firearm may include the magazine coupled to the underside of the firearm.

According to another embodiment, a magazine for a firearm comprises: a cavity sized to receive a plurality of cartridges; wherein the magazine is configured so that the plurality of cartridges exit the cavity at least approximately in the center of the magazine; and wherein the magazine is configured to be inserted upward into an underside of the firearm. Each of the plurality of cartridges may include a bullet coupled to a case having a shoulder, and the cavity may be shaped so that the shoulders of the cases contact the magazine to prevent the bullets from moving forward longitudinally and contacting the magazine. All of the plurality of cartridges may be positioned one above another when the magazine is fully loaded. The magazine may comprise a movable member positioned in the cavity, the movable member being configured to rotate and push the plurality of cartridges upward in the cavity. The movable member may be configured to rotate a total of no more than 180 degrees. The movable member may be configured to rotate backward no more than 90 degrees past a straight down position. The movable member may be a flat plate.

According to another embodiment, a magazine for a firearm comprises: a cavity sized to receive a plurality of cartridges; and a movable member positioned in the cavity, the movable member being configured to rotate and push the plurality of cartridges upward in the cavity; wherein the movable member is configured to rotate a total of no more than 180 degrees. Each of the plurality of cartridges may include a bullet coupled to a case having a shoulder, and the cavity may be shaped so that the shoulders of the cases contact the magazine to prevent the bullets from moving forward longitudinally and contacting the magazine. All of the plurality of cartridges may be positioned one above another when the magazine is fully loaded. The movable member may be configured to rotate backward no more than 90 degrees past a straight down position. The movable member may be a flat plate.

According to another embodiment, a magazine for a firearm comprises: a cavity sized to receive a plurality of cartridges; a movable member positioned in the cavity, the movable member being configured to rotate and push the plurality of cartridges upward in the cavity; wherein all of the plurality of cartridges are positioned one above another when the magazine is fully loaded. Each of the plurality of cartridges may include a bullet coupled to a case having a shoulder, and the cavity may be shaped so that the shoulders of the cases contact the magazine to prevent the bullets from moving forward longitudinally and contacting the magazine. The movable member may be configured to rotate backward no more than 90 degrees past a straight down position. The movable member may be a flat plate.

According to another embodiment, a magazine for a firearm comprises: a cavity sized to receive a plurality of cartridges each of which includes a bullet coupled to a case having a shoulder; wherein the cavity is shaped so that the shoulders of the cases contact the magazine to prevent the bullets from moving forward longitudinally and contacting the magazine; and wherein the magazine is configured to be inserted upward into an underside of the firearm.

According to another embodiment, a magazine for a firearm comprises: a cavity sized to receive a plurality of cartridges each of which includes a case coupled to a bullet having a tip; wherein the cavity is shaped to prevent the tips of the bullets from contacting the magazine; and wherein the magazine is configured to be inserted upward into an underside of the firearm.

According to another embodiment, a magazine for a firearm comprises: one or more surfaces that define a cavity sized to receive a plurality of cartridges each of which includes a bullet; wherein the cavity is shaped to prevent the bullets from moving forward longitudinally and contacting the one or more surfaces that define the cavity; and wherein the magazine is configured to be inserted upward into an underside of the firearm.

According to another embodiment, a magazine for a firearm comprises: one or more surfaces which define a cavity sized to receive a plurality of cartridges each of which includes a bullet coupled to a case having a shoulder; wherein the cavity is shaped so that the shoulders of the cases contact the one or more surfaces that define the cavity to prevent the bullets from the plurality of cartridges from moving forward longitudinally and contacting the one or more surfaces that define the cavity; and wherein the magazine is configured to be inserted upward into an underside of the firearm.

According to another embodiment, a magazine for a firearm comprises: one or more surfaces which define a cavity sized to receive a plurality of cartridges each of which includes a case coupled to a bullet having a tip; wherein the cavity is shaped to prevent the tips of the bullets from contacting the one or more surfaces that define the cavity; and wherein the magazine is configured to be inserted upward into an underside of the firearm.

According to another embodiment, a magazine for a firearm comprises: a cavity sized to receive a plurality of cartridges; wherein the magazine is configured so that the plurality of cartridges exit the cavity at a position that is at least approximately directly below a bore of the firearm; and wherein the magazine is configured to be inserted upward into an underside of the firearm.

According to another embodiment, a firearm comprises: a barrel having a bore; a receiver assembly coupled to the barrel; and a magazine configured to hold a plurality of cartridges, the magazine being configured so that the plurality of cartridges exit the magazine at a position that is at least approximately directly below the bore; wherein the magazine is configured to be inserted upward into an underside of the receiver assembly.

According to another embodiment, a magazine for a firearm comprises: a cavity sized to receive a plurality of cartridges; and a follower positioned in the cavity, the follower being configured to rotate and push the plurality of cartridges upward in the cavity; wherein the follower rotates no more than 180 degrees.

According to another embodiment, a magazine for a firearm comprises: a cavity sized to receive a plurality of cartridges; and a biasing mechanism positioned in the cavity, the biasing mechanism including a biasing member configured to bias the plurality of cartridges upward in the cavity; wherein the biasing member rotates no more than 180 degrees.

According to another embodiment, a magazine for a firearm comprises: a cavity sized to receive a plurality of cartridges; and a movable member positioned in the cavity, the movable member being configured to rotate and push the plurality of cartridges upward in the cavity; wherein the movable member is configured to rotate backward no more than 90 degrees past a straight down position when the magazine is fully loaded. The movable member may be configured to rotate backward no more than 45 degrees past a straight down position when the magazine is fully loaded. The movable member may be configured to rotate backward no more than 30 degrees past a straight down position when the magazine is fully loaded.

According to another embodiment, a magazine for a firearm comprises: a cavity sized to receive a plurality of cartridges; a movable member positioned in the cavity, the movable member being configured to rotate and push the plurality of cartridges upward in the cavity; wherein the magazine is no more than 32 mm wide.

According to another embodiment, a magazine for a firearm comprises: a cavity sized to receive a plurality of cartridges; and a movable member positioned in the cavity, the movable member being configured to rotate and push the plurality of cartridges upward in the cavity; wherein the movable member is a flat plate.

According to another embodiment, a method of loading a firearm comprises: placing a plurality of cartridges in a magazine, each of the plurality of cartridges including a bullet, wherein the magazine includes a cavity that is shaped to prevent the bullets from moving forward longitudinally and contacting the magazine; and inserting the magazine upward into an underside of the firearm.

According to another embodiment, a method of loading a firearm comprises: placing a plurality of cartridges in a magazine, the magazine being configured so that the plurality of cartridges exit the cavity at approximately the center of the magazine; and inserting the magazine upward into an underside of the firearm.

According to another embodiment, a method of loading a firearm comprises: placing a plurality of cartridges in a magazine; and inserting the magazine upward into an underside of the firearm so that the plurality of cartridges exit the magazine at a position that is at least approximately directly below a bore of the firearm.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A magazine for a firearm comprising:

a cavity sized to receive a plurality of cartridges each of which includes a bullet coupled to a case having a shoulder, the cavity including opposing walls that contact opposite sides of the shoulder of each cartridge to prevent the bullets from moving forward longitudinally and contacting a front wall of the magazine;

a movable member positioned in the cavity, the movable member being configured to rotate and push the plurality of cartridges out of the cavity, the movable member having a total range of motion that is no more than 180 degrees;

wherein the magazine is a rotary magazine; and wherein the magazine is configured to be inserted upward into an underside of the firearm.

2. The magazine of claim 1 wherein the magazine is configured so that the plurality of cartridges exit the cavity at least approximately in the center of the magazine.

3. The magazine of claim 1 wherein all of the plurality of cartridges are positioned so that each preceding cartridge is above the next succeeding cartridge when the magazine is fully loaded.

4. The magazine of claim 1 wherein the movable member is configured to rotate backward no more than 90 degrees past a straight down position.

5. The magazine of claim 1 wherein the movable member includes a flat plate that rotates and pushes the plurality of cartridges out of the cavity.

6. The magazine of claim 1 wherein the magazine is no more than 32 mm wide.

7. The magazine of claim 1 wherein the plurality of cartridges are centerfire cartridges.

8. A firearm including the magazine of claim 1 coupled to the underside of the firearm.

9. The magazine of claim 1 comprising retaining edges that hold the plurality of cartridges in the cavity when the magazine is separate from the firearm.

10. A magazine for a firearm comprising:

a cavity sized to receive a plurality of cartridges;

retaining edges that prevent the plurality of cartridges from coming out the top of the cavity when the magazine is separate from the firearm; and a movable member positioned in the cavity, the movable member being configured to rotate and push the plurality of cartridges out of the cavity;

wherein the movable member has a total range of motion that is no more than 180 degrees;

wherein the magazine is configured so that the plurality of cartridges exit the cavity in the center of the magazine; and wherein the magazine is configured to be inserted upward into an underside of the firearm.

11. The magazine of claim 10 wherein each of the plurality of cartridges includes a bullet coupled to a case having a shoulder, and wherein the cavity is shaped so that the shoulders of the cases contact the magazine to prevent the bullets from moving forward longitudinally and contacting the magazine.

12. The magazine of claim 10 wherein all of the plurality of cartridges are positioned so that each preceding cartridge is above the next succeeding cartridge when the magazine is fully loaded.

13. The magazine of claim 10 wherein the movable member is configured to rotate backward no more than 90 degrees past a straight down position.

14. The magazine of claim 10 wherein the movable member includes a flat plate that rotates and pushes the plurality of cartridges out of the cavity.

15. The magazine of claim 10, wherein the magazine is configured so that the plurality of cartridges are received by moving the plurality of cartridges downward and rearward into the cavity and under the retaining edges.

16. The magazine of claim 10, wherein the plurality of cartridges are directed out of the magazine longitudinally by the retaining edges when the magazine is mounted to the firearm.

17. The magazine of claim 10, wherein the retaining edges require insertion of the plurality of cartridges into the cavity with sliding movement in a longitudinal direction under the retaining edges.

18. The magazine of claim 10 wherein the movable member includes a flat plate that rotates and pushes the plurality of cartridges out of the cavity.

19. The magazine of claim 10 wherein the magazine is configured so that the plurality of cartridges exit the cavity in the center of the magazine.

20. A magazine for a firearm comprising:

a cavity sized to receive a plurality of cartridges; and a movable member positioned in the cavity, the movable member being configured to rotate and push the plurality of cartridges out of the cavity;

wherein the movable member has a total range of motion that is no more than 180 degrees; and wherein the movable member rotates about an axis that is offset to the side of a center line extending vertically though the center of the magazine.

21. The magazine of claim 20 wherein each of the plurality of cartridges includes a bullet coupled to a case having a shoulder, and wherein the cavity is shaped so that the shoulders of the cases contact the magazine to prevent the bullets from moving forward longitudinally and contacting the magazine.

22. The magazine of claim 20 wherein all of the plurality of cartridges are positioned so that each preceding cartridge is above the next succeeding cartridge when the magazine is fully loaded.

23. The magazine of claim 20 wherein the movable member is configured to rotate backward no more than 90 degrees past a straight down position.

24. The magazine of claim 20 wherein the movable member includes a flat plate that rotates and pushes the plurality of cartridges out of the cavity.

25. The magazine of claim 20 comprising retaining edges that hold the plurality of cartridges in the cavity when the magazine is separate from the firearm.

26. A magazine for a firearm comprising:

a cavity sized to receive a plurality of cartridges;

a movable member positioned in the cavity, the movable member being configured to rotate and push the plurality of cartridges out of the cavity;

wherein all of the plurality of cartridges are positioned so that each preceding cartridge is above the next succeeding cartridge when the magazine is fully loaded; and wherein the movable member rotates about an axis that is offset to the side of a center line extending vertically though the center of the magazine.

27. The magazine of claim 26 wherein each of the plurality of cartridges includes a bullet coupled to a case having a shoulder, and wherein the cavity is shaped so that the shoulders of the cases contact the magazine to prevent the bullets from moving forward longitudinally and contacting the magazine.

28. The magazine of claim 26 wherein the movable member is configured to rotate backward no more than 90 degrees past a straight down position.

29. The magazine of claim 26 wherein the movable member includes a flat plate that rotates and pushes the plurality of cartridges out of the cavity.

30. The magazine of claim 26 comprising retaining edges that hold the plurality of cartridges in the cavity when the magazine is separate from the firearm.

31. A magazine for a firearm comprising:

a cavity sized to receive a plurality of cartridges; and a movable member positioned in the cavity, the movable member being configured to rotate no more than 180 degrees when the cavity is fully loaded, the movable member configured to push the plurality of cartridges out of the cavity;

wherein the movable member rotates about an axis that is offset to the side of a center line extending vertically though the center of the magazine.

32. The magazine of claim 31 wherein each of the plurality of cartridges includes a bullet coupled to a case having a shoulder, and wherein the cavity is shaped so that the shoulders of the cases contact the magazine to prevent the bullets from moving forward longitudinally and contacting the magazine.

* * * * *